US007217088B2

(12) United States Patent
Albrecht et al.

(10) Patent No.: US 7,217,088 B2
(45) Date of Patent: May 15, 2007

(54) COOLING FLUID PREHEATING SYSTEM FOR AN AIRFOIL IN A TURBINE ENGINE

(75) Inventors: Harry A. Albrecht, Hobe Sound, FL (US); Yevgeniy Shteyman, West Palm Beach, FL (US)

(73) Assignee: Siemens Power Generation, Inc., Orlando, FL (US)

( * ) Notice: Subject to any disclaimer, the term of this patent is extended or adjusted under 35 U.S.C. 154(b) by 200 days.

(21) Appl. No.: 11/049,239

(22) Filed: Feb. 2, 2005

(65) Prior Publication Data

US 2006/0171809 A1 Aug. 3, 2006

(51) Int. Cl.
*F03B 11/02* (2006.01)

(52) U.S. Cl. ..... 415/115; 415/116; 416/96 R; 416/97 R

(58) Field of Classification Search ..... 415/115, 415/116; 416/96 R, 97 R, 95
See application file for complete search history.

(56) References Cited

U.S. PATENT DOCUMENTS 3,849,025 A * 11/1974 Grondahl ..... 416/97 R
4,017,210 A * 4/1977 Darrow ..... 416/97 R
5,279,111 A 1/1994 Bell et al.
6,206,638 B1 3/2001 Glynn et al.
6,213,714 B1 4/2001 Rhodes
6,283,708 B1 9/2001 Zelesky
6,554,563 B2 4/2003 Noe et al.
7,097,418 B2 * 8/2006 Trindade et al. ..... 415/115
2003/0059305 A1 3/2003 Bather et al.
2003/0223861 A1 12/2003 Morrison et al.
2004/0115053 A1 6/2004 Shi et al.
2004/0151587 A1 8/2004 Cunha et al.
2004/0202542 A1 10/2004 Cunha et al.

* cited by examiner

*Primary Examiner*—Edward K. Look
*Assistant Examiner*—Dwayne J White

(57) ABSTRACT

A platform cooling system usable in a turbine engine together with an airfoil for preheating cooling fluids before the cooling fluids enter a cooling system in the airfoil in a turbine engine. The platform cooling system includes cooling channels in either the ID or OD platforms, or both, of the airfoil. The channels transfer heat to the cooling fluids flowing through the platform cooling system and thereby heat the cooling fluids. The preheated cooling fluids are particularly useful with cooling composite ceramic airfoils, which are susceptible to damage from large temperature gradients developed between combustion gases outside the airfoil and cooling fluids inside the airfoil. The platform cooling system may be combined with an airfoil cooling system to create a serial cooling system in which cooling fluids may enter the platform and flow through the platform and airfoil without being supplemented with additional cooling fluids along the flow path.

12 Claims, 4 Drawing Sheets

COOLING FLUID PREHEATING SYSTEM FOR AN AIRFOIL IN A TURBINE ENGINE

FIELD OF THE INVENTION

This invention is directed generally to airfoils in turbine engines, and more particularly to airfoils having a need for reduced temperature gradients within the airfoil, such as composite airfoils.

BACKGROUND

Typically, gas turbine engines include a compressor for compressing air, a combustor for mixing the compressed air with fuel and igniting the mixture, and a turbine blade assembly for producing power. Combustors often operate at high temperatures that may exceed 2,500 degrees Fahrenheit. Typical turbine combustor configurations expose turbine vane and blade assemblies, to these high temperatures. As a result, turbine airfoils, such as turbine vanes and blades must be made of materials capable of withstanding such high temperatures. In addition, turbine airfoils often contain internal cooling systems for prolonging the life of the airfoils and reducing the likelihood of failure as a result of excessive temperatures.

Typically, turbine airfoils, such as turbine vanes are formed from an elongated portion having one end configured to be coupled to an outer shroud vane carrier and an opposite end configured to be movably coupled to an inner shroud. The airfoil is ordinarily composed of a leading edge, a trailing edge, a suction side, and a pressure side. The inner aspects of most turbine vanes typically contain an intricate maze of cooling circuits forming a cooling system. The cooling circuits in the vanes receive air from the compressor of the turbine engine and pass the air through the ends of the vane adapted to be coupled to the vane carrier. The cooling circuits often include multiple flow paths that are designed to remove heat from the turbine vane. At least some of the air passing through these cooling circuits is exhausted through orifices in the leading edge, trailing edge, suction side, and pressure side of the vane.

Composite airfoils have been developed for use in turbine engines as composite materials are typically suitable to use in higher temperature environments that conventional metals forming airfoils. Composite airfoils are often constructed as laminate layers formed from high strength fibers woven into a cloth that is saturated with a ceramic matrix material. The multiple laminate layers are stacked, compacted to the desired thickness, dried, and fired to achieve the desired structural properties. The laminates have desirable in-plane structural properties but significantly less strength in the through plane direction. The composite airfoils are often formed from an inner solid core, a laminate layer, and a FGI insulating thermal barrier coating. A ceramic bond exists between the laminate and solid core and at the interface of the laminate and thermal barrier coating.

The composite airfoils have been cooled in conventional composite airfoils by passing cooling air from a compressor through the airfoil. Typically, the cooling fluids are passed through a plurality of cooling channels and exhausted through the trailing edge of the composite airfoil without use of film cooling. While outer surfaces of composite airfoils are typically exposed to temperatures of about 1,600 degrees Celsius in a turbine engine, the laminate layer of the airfoil is generally kept at a temperature less than about 1,100 degrees Celsius. Typically, cooling air used in a composite airfoil cooling system is about 450 degrees Celsius. The extreme temperature gradient between the combustion gases at 1,600 degrees Celsius outside of the airfoil and the cooling gases at 450 degrees Celsius in the interior cooling channels creates thermal stress in the composite airfoil that can delaminate the laminate layer and destroy bonds between the laminate layer and the inner core and between the laminate layer and the thermal barrier coating. Such problems with thermal stress do not exist in metal airfoils because of the high thermal conductivity of the metal forming the airfoil and high strength of the metal. Thus, a need exists for reducing the thermal stresses created by cooling fluids in composite airfoils in turbine engines.

SUMMARY OF THE INVENTION

This invention relates to a preheating system for cooling fluids in an airfoil of a turbine engine. The invention also relates to use of the preheating system to form a serial cooling system for a composite turbine airfoil in which the preheating system in the platform and a cooling system in the airfoil form a continuous cooling system not supplemented with additional cooling fluids along the cooling system from a first end of the preheating system in the platform to an exhaust of the cooling system in the airfoil. By preheating the cooling fluids in the platform of an airfoil, the temperature gradient that develops in the airfoil is reduced, thereby reducing the thermal stresses in the airfoil.

In at least one embodiment, the cooling fluid preheating system is a platform cooling system positioned in one or more platforms of an airfoil for heating cooling fluids before the cooling fluids enter an internal cooling system in inner aspects of the airfoil. The platform cooling system may be formed from one or more channels in the first platform that are in communication with the cooling system in the elongated airfoil. Heat is removed from the platform and used to heat the cooling fluids passing through the channels in the platform forming the cooling fluid preheating system. The platform cooling system is particularly suited for use with composite airfoils, such as, but not limited to ceramic matrix composites, to reduce the temperature gradients between outer surfaces of an airfoil and inner cooling channels to reduce the risk of delamination and other failure of the airfoil.

The platform cooling system may be positioned in an inner diameter (ID) platform or in an outer diameter (OD) platform of an airfoil, or both. In at least one embodiment, the platform cooling system may include one or more cooling channels extending in close proximity to an outer surface of the platform so that cooling fluids flowing through the cooling channel may increase in temperature. In a composite airfoil, the cooling channels may be formed from a plurality of parallel spaced cooling channels extending generally along an outer surface of a platform and sealed with an outer composite layer, which may be, but is not limited to being, fiberglass.

The channels of the platform cooling system may be supplied with cooling fluids from a cooling fluid supply through numerous means. In at least one embodiment, the platform cooling system may include leading edge cooling fluid supply holes in the platform and proximate to the leading edge of the airfoil, and one or more trailing edge cooling fluid supply holes in the platform and proximate to the trailing edge of the airfoil. The leading and trailing edge cooling supply holes may be positioned at an angle of between about 30 degrees and about 60 degrees relative to a longitudinal axis of the airfoil. The leading and trailing edge cooling supply holes may extend between a cooling fluid supply chamber positioned between the platform and a shroud, and may include an airfoil cooling fluid supply chamber at the interface between the platform and the airfoil. The leading and trailing edge cooling fluid supply holes may have any design capable of generating the desired residency time of the cooling fluids in the platform so that the temperature of the cooling fluids may increase a desired amount.

The airfoil may be formed from a variety of materials and configurations. In at least one embodiment, the airfoil may be formed from an inner core encapsulated by a laminate layer, which may be, but is not limited to being, the ceramic matrix composite, and may include an outer thermal boundary coating (TBC). The airfoil may include a leading edge, a trailing edge, a pressure side, a suction side, a first platform at a first end of the airfoil, a second platform at a second end of the airfoil opposite the first end, and a cooling system formed from at least one internal cooling channel in the airfoil. In a composite airfoil, the cooling system may include, but is not limited to including, a leading edge cooling supply chamber extending generally radially within the airfoil, a plurality of pressure side channels extending generally chordwise within the inner core of the airfoil proximate to a laminate layer, and a plurality of suction side channels extending generally chordwise within the inner core of the airfoil proximate to the laminate layer. The airfoil cooling system may also include a trailing edge supply channel that extends radially within the airfoil and a plurality of trailing edge cooling channels extending generally chordwise within the airfoil for exhausting cooling fluids from the airfoil.

During use, the cooling fluids, which may be, but are not limited to, air, flow from a cooling fluid source, such as, but not limited to, a compressor, to a cooling fluid supply manifold proximate to the airfoil platform. The cooling fluids are then distributed to cooling channels forming the preheating system by flowing through the platform, such as the leading and trailing edge cooling fluid supply holes and the platform cooling channels. The cooling fluids increase in temperature as the cooling fluids flow through the platform. In at least one embodiment, the cooling fluids may increase between about 200 degrees Celsius and about 300 degrees Celsius. The cooling fluids collect in the airfoil cooling fluid supply chamber proximate to the airfoil and are passed into the airfoil cooling system.

In at least one embodiment, the cooling fluid preheating system in the platform and the airfoil cooling system form a single cooling system in which the cooling fluids are not supplemented with additional cooling fluids along the length of the cooling pathway from a first end of the cooling system in the platform to an exhaust of the cooling system in the airfoil. In this embodiment, cooling fluids flow into the leading edge cooling fluid supply chamber of an airfoil and into pressure and suction side channels. The cooling fluids increase in temperature while flowing through the airfoil, thereby causing the temperature of the airfoil to decrease. The cooling fluids are then passed from the pressure side and suction side channels into a trailing edge cooling fluid supply chamber. The cooling fluids are then passed into trailing edge cooling channels and exhausted from the airfoil through the trailing edge cooling channels.

By preheating the cooling fluids in the platform, the temperature gradient that exists between the outer surface of the airfoil and the inner surfaces of the airfoil cooling channels is reduced when compared with conventional cooling systems. The reduction in the temperature gradient between outside surfaces of the airfoil and the cooling fluids in the cooling channels in the airfoil advantageously reduces the thermal stress encountered by the airfoil and therefore, increases the life of the airfoil. Such stress reduction increases the viability of use of composite blades in turbine engines.

An advantage of this invention is that the platform cooling system greatly reduces the temperature gradient across an airfoil in a turbine engine, and thus, reduces the thermal stress in the airfoil as well. The reduction in thermal stress is particularly advantageous for composite airfoils that are susceptible to damage, such as delamination between layers and destruction of bonds, resulting from temperature gradients.

Another advantage of this invention is that the platform cooling system makes use of airfoils formed from composite materials more viable by reducing the thermal stresses that damage composite materials. Because composite airfoils can withstand higher temperatures than conventional metals used to form airfoils, less cooling fluids are needed in composite airfoils. In fact, use of composite airfoils may reduce the total cooling fluid flow requirement by approximately 90 percent. Such a reduction in cooling fluid flow can greatly improve the efficiency of the gas turbine engine in which the platform cooling system is installed.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

As shown in FIGS. 1–7, this invention is directed to a platform cooling system 10 usable to preheat cooling fluids in a turbine engine. The platform cooling system 10 is particularly useful in composite airfoils 12 in which temperature gradients cause layers of the airfoil 12 to delaminate and bonds between adjacent layers to break. In addition, the platform cooling system 10 may be incorporated with an internal cooling system 14 in the airfoil 12 such that the airfoil is cooled with cooling air in a serial cooling manner such that cooling fluids passed through the platform cooling system 10 flow through the airfoil 12 without being supplemented by lower temperature cooling air while in the airfoil 12.

The platform cooling system 10 may receive cooling fluids from a compressor (not shown) or other source, increase the temperature of the cooling fluids, and pass the cooling fluids on to a cooling system 14 in the airfoil 12 with a temperature that is greater than a temperature of the cooling fluids entering the platform cooling system 10. In at least one embodiment, the cooling fluids, which may be, but are not limited to, air, may be heated between about 200 degrees and 300 degrees in the platform cooling system 10.

Figure 1:
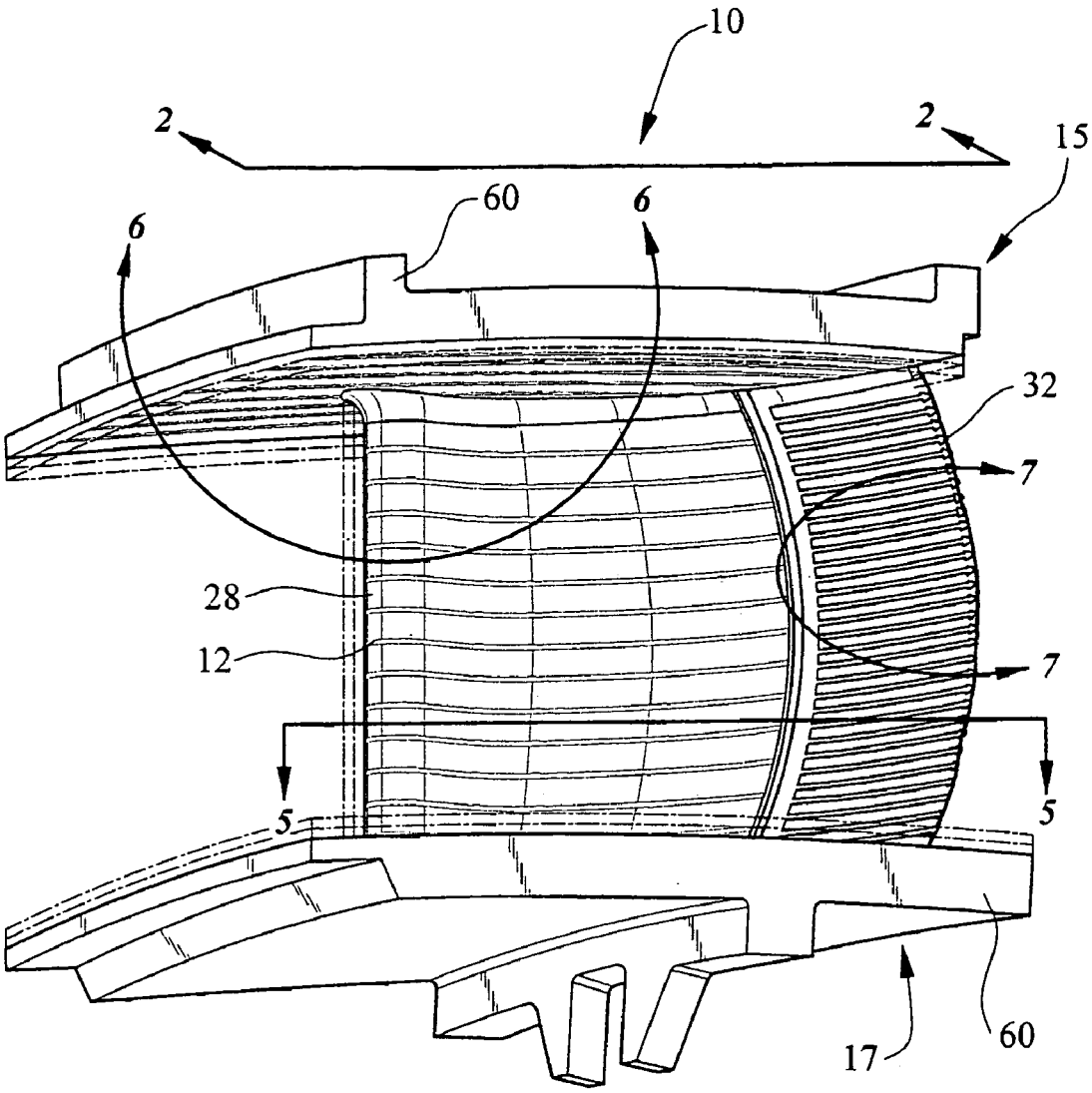
FIG. 1 is a perspective view of an airfoil having features according to the instant invention with an outer layer removed revealing inner cooling channels.

As shown in FIG. 1, the platform cooling system 10 may be positioned in a platform 16 of an airfoil 12. The platform cooling system 10 may be included in either an outer diameter (OD) region 15 or an inner diameter (ID) region 17, or both. For simplicity of discussion, the platform cooling system 10 will be discussed as being in the OD region 15, but, as previously discussed, the platform cooling system 10 may also be in the ID region 17 alternatively or in addition to being in the OD region 15. The platform cooling system 10 may be in communication with a cooling fluid source (not shown) and a cooling system 14 in the airfoil 12.

Figure 5:
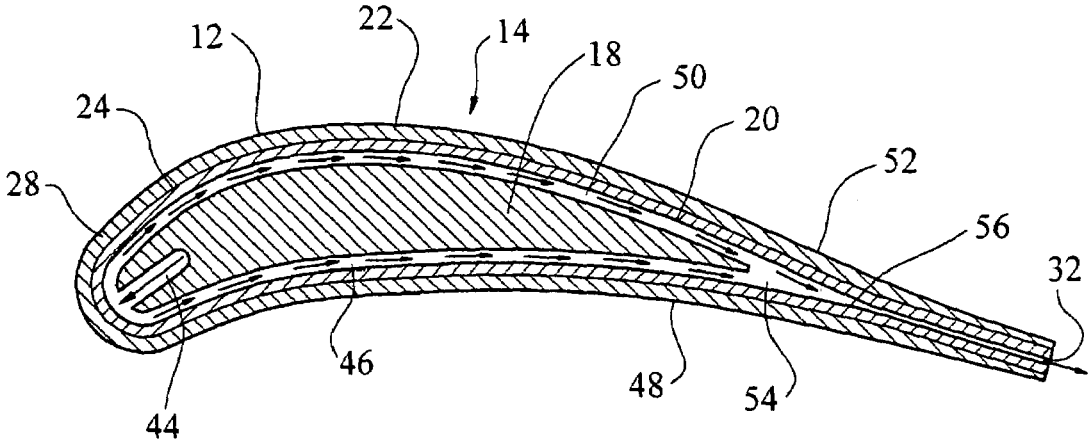
FIG. 5 is a cross-sectional view of the airfoil shown in FIG. 1 taken along section line 5—5.

In at least one embodiment, as shown in FIG. 5, the airfoil 12 may be formed from a composite airfoil 12. The composite airfoil 12 may be formed from a monolithic structure or a multi-component structure. In at least one embodiment, the composite airfoil 12 may be formed from an inner core 18, a laminate layer 20, and a thermal barrier coating 22. The laminate layer 20 may be, but is not limited to being, a ceramic matrix composite material having an outer surface 24 defining the airfoil 12. The ceramic matrix composite may be any fiber reinforced ceramic matrix material or other appropriate material. The fibers and matrix material surrounding the fibers may be oxide ceramics or non-oxide ceramics, or any combination thereof. The ceramic matrix composite may combine a matrix material with a reinforcing phase of a different composition, such as, but not limited to, mullite/alumina, or of the same composition, such as, but not limited to, alumina/alumina, mullite/mullite or silicon carbide/silicon carbide. The ceramic matrix composite may also be reinforced with plies of adjacent layers being directionally oriented to obtain the desired strength. In at least one embodiment, the laminate layer 20 may be formed from A-N720, which is available from COI Ceramics, San Diego, Calif. with mullite-alumina Nextel 720 reinforcing fibers in an alumina matrix. The thermal barrier coating 22 may be formed from the composition described in U.S. Pat. No. 6,197,424 or other appropriate material. As shown in FIG. 5, the thermal barrier coating 22 may have a larger thickness near the leading edge 28 than at the trailing edge 32 as the heating load on the leading edge 28 is greater than the heating load on the trailing edge 32. The inner core 18 may be, but is not limited to being, AN-191, which is available from Saint-Gobain, Worcester, Mass.

Figure 2:
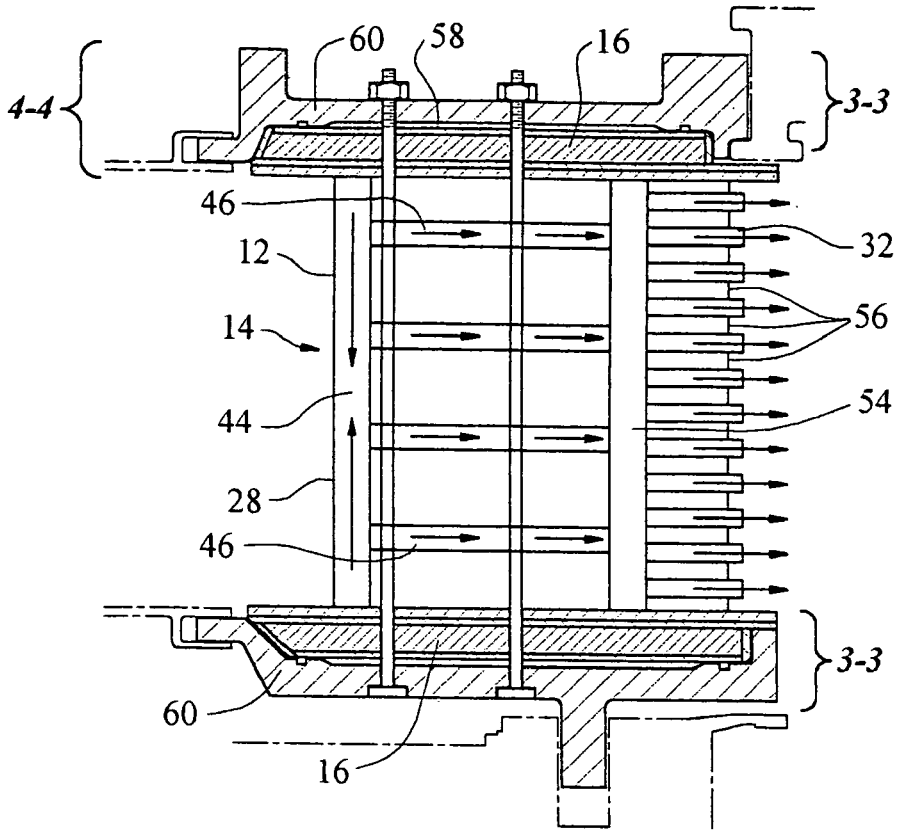
FIG. 2 is a cross-sectional view of the airfoil shown in FIG. 1 taken along section line 2—2.
Figure 3:
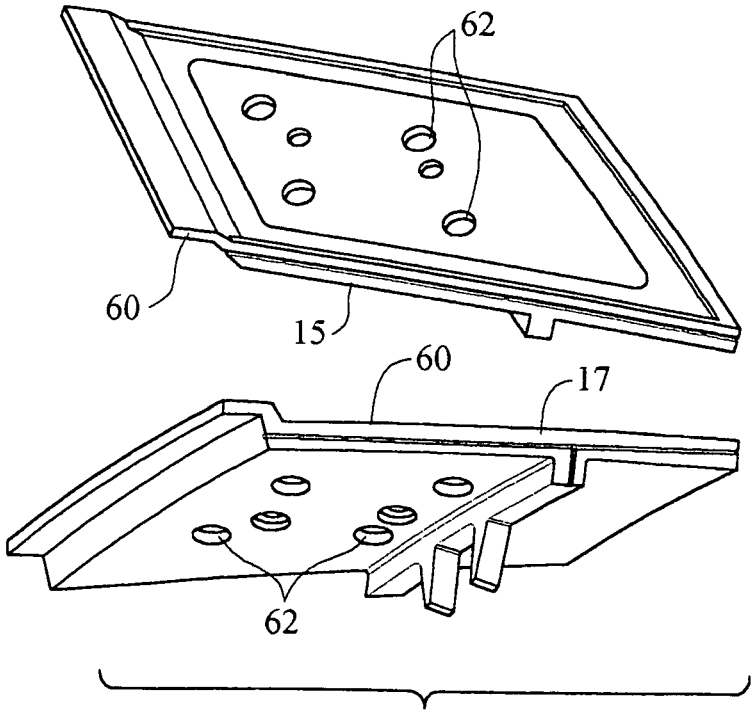
FIG. 3 is a perspective view of platforms of the airfoil shown in FIG. 2 taken at detail 3—3.
Figure 4:
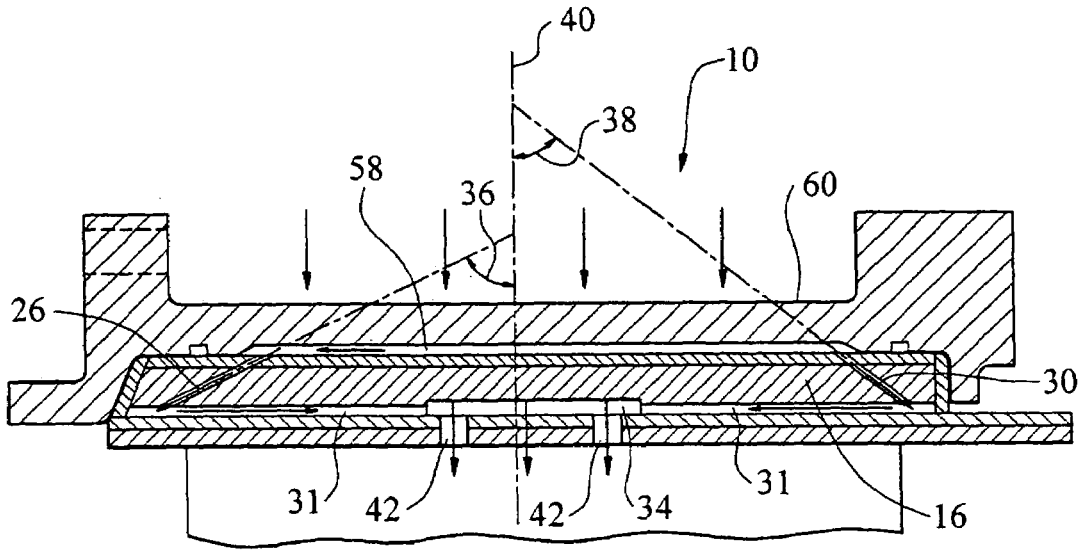
FIG. 4 is a detailed cross-sectional view of the airfoil shown in FIG. 2.

In at least one embodiment, as shown in FIGS. 2 and 4, the platform cooling system 10 may be formed from one or more cooling channels 31 for preheating cooling fluids in the platform 16. The cooling channel 31 may be in communication with a cooling fluid source and with the cooling system 14 of the airfoil 12. The leading and trailing edge cooling fluid supply holes 26, 30 may be sized with cross-sectional areas to accommodate the amount of cooling fluids needed by the cooling system 14 in the airfoil 12. The leading and trailing edge cooling fluid supply holes 26, 30 may also have any configuration necessary to give cooling fluids the necessary resident time in the platform 16 to sufficiently increase in temperature.

In at least one embodiment, the cooling channel 31 may include one or more leading edge cooling fluid supply holes 26 in the platform 16 positioned proximate to a leading edge 28 of the airfoil 12, and may also include one or more trailing edge cooling fluid supply holes 30 in the platform 16 positioned proximate to the trailing edge 32 of the airfoil 12. As shown in FIG. 4, the leading and trailing edge cooling fluid supply holes 26, 30 may be positioned at angles 36, 38, respectively, which may be between about 30 and 60 degrees relative to a longitudinal axis 40 of the airfoil 12. The leading and trailing edge cooling fluid supply holes 26, 30 may be positioned at the same angle or at different angles. In an alternative configuration, a central cooling channel may extend through the platform 16 in a central region not near the leading or trailing edges 28, 32 of the airfoil 12.

Figure 6:
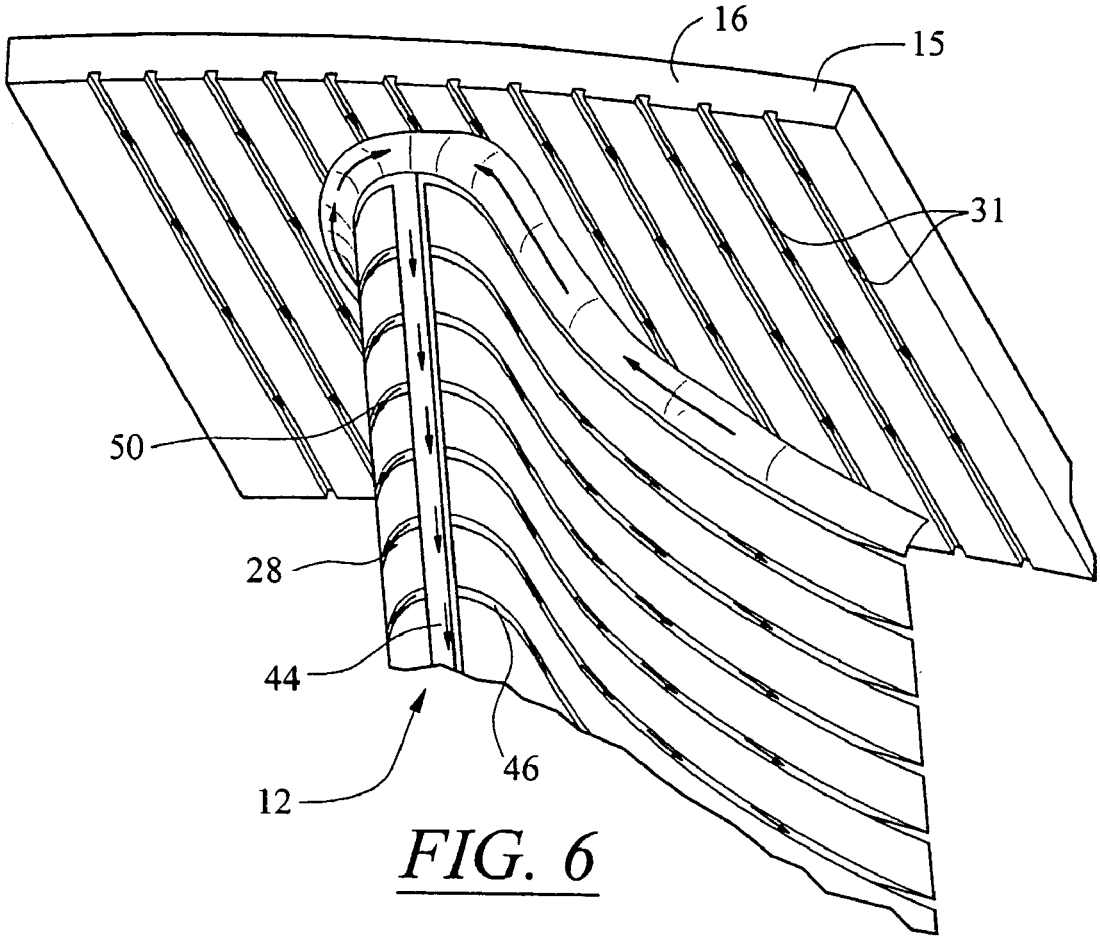
FIG. 6 is a detailed perspective view of the airfoil shown in FIG. 1 at detail 6—6.

The leading and trailing edge cooling fluid supply holes 26, 30 supply cooling fluids to the plurality of platform cooling channels 31. The platform cooling channels 31 pass cooling fluids through the platform 16, thereby increasing the temperature of the cooling fluids, and supply cooling fluids to an airfoil cooling fluid supply chamber 34 positioned at the interface between the platform 16 and the airfoil 12. As shown in FIG. 6, the platform cooling channels 31 may extend along an outer surface of the platform. The platform cooling channels 31 may have any shape and configuration capable of sufficiently preheating the cooling fluids flowing through the platform 16. In at least one embodiment, as shown in FIG. 6, the platform cooling channels 31 are positioned generally parallel to each other and extend along the platform 16. The platform cooling channels 31 may be formed on an outer surface of the platform 16 and covered with an outer layer 33, as shown in FIG. 2. In at least one embodiment, the outer layer 33 may be formed from a fiberglass cloth or other appropriate material.

The airfoil cooling fluid supply chamber 34 may have any configuration appropriate for receiving cooling fluids from the platform cooling channels 31 and passing the cooling fluids to the cooling system 14 in the airfoil 12. As shown in FIG. 4, the airfoil cooling fluid supply chamber 34 may be an elongated chamber positioned between the interface of the platform 16 and the airfoil 12. The airfoil cooling fluid supply chamber 34 may be in communication with the cooling system 14 through one or more airfoil supply holes 42.

Figure 7:
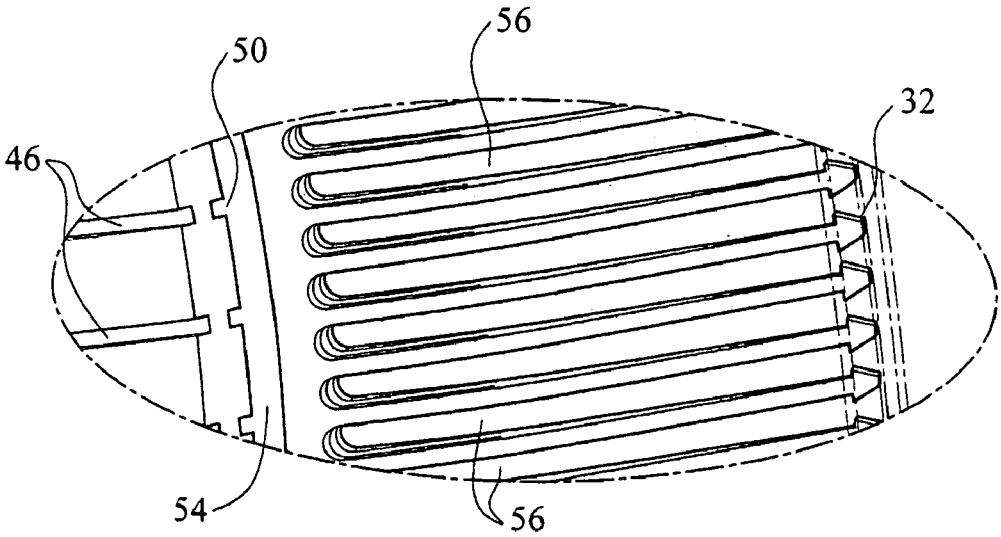
FIG. 7 is a detailed view of a trailing edge cooling channels in the airfoil shown in FIG. 1 taken at detail 7—7.

The cooling system 14 may be any cooling system 14 capable of adequately cooling the airfoil 12. In at least one embodiment, as shown in FIGS. 2, 5, and 6, the cooling system 14 may be a serial cooling system in which the cooling fluids are not supplemented with reduced temperature cooling fluids as the cooling fluids flow through the airfoil 12. Instead, the cooling fluids flow throughout the entire airfoil cooling system 14 without having cooling fluids added. As shown in FIGS. 2, 5, and 6, the cooling system 14 may be formed from a leading edge cooling fluid supply chamber 44 that extends radially along the leading edge of the airfoil 12 and a trailing edge supply channel 54, as shown in FIGS. 1, 2, and 7, positioned in the trailing edge for receiving cooling fluids from pressure side and suction side channels 48, 52. The cooling system 14 may also include a plurality of pressure side channels 46 positioned in the inner core 18 proximate to the laminate layer 20 on the pressure side 48 of the airfoil 12 and a plurality of suction side channels 50 positioned in the inner core 18 proximate to the laminate layer 20 on the suction side 52 of the airfoil 12. The pressure and suction side channels 46, 50 extend generally in the chordwise direction from the leading edge cooling fluid supply chamber 44 to the trailing edge supply channel 54. The cooling system 14 may also include a plurality of trailing edge cooling channels 56 in the trailing edge 32 of the airfoil 12 extending generally chordwise from the trailing edge supply channel 54 to the trailing edge 32 of the airfoil 12.

The platform cooling system 10 may also include a cooling supply manifold 58 positioned between a shroud 60 and the platform 16. The shroud 60 may include one or more cooling fluid supply holes 62 providing a pathway for cooling fluids through the shroud 60. As shown in one embodiment in FIG. 3, the shroud 60 may include four cooling fluid supply holes 62.

During operation, cooling fluids, which may be but are not limited to, air, may be channeled from a compressor, or other source, to a cooling supply manifold 58 through cooling fluid supply holes 62. The cooling fluid collects in the cooling supply manifold 58 and flows through the one or more leading and trailing edge cooling fluid supply holes 26, 30 to the platform cooling channels 31. As the cooling fluids flow through the cooling fluid supply holes 26, 30 and the platform cooling channels 31, the cooling fluids increase in temperature. In at least one embodiment, the airfoil 12 may be exposed to gases having temperatures of about 1,600 degrees Celsius, and the cooling fluid entering the platform cooling system 10 may be about 450 degrees Celsius. After flowing through the platform cooling system 10, the cooling fluids may increase in temperature between about 200 degrees Celsius to about 300 degrees Celsius. Thus, the cooling fluids may be about 650 degrees Celsius to about 750 degrees Celsius upon entering the cooling system 14 in the airfoil 12. The cooling fluids collect in the airfoil cooling fluid supply chamber 34 and are passed through airfoil supply holes 42 into the cooling system 14 of the airfoil 12. The cooling fluids then flow through the leading edge cooling fluid supply chamber 44 and into the pressure and suction side channels 46, 50, where the cooling fluids increase in temperature. The cooling fluids collect in the trailing edge supply channel 54 with a temperature of about 750 degrees Celsius and are distributed into the trailing edge cooling channels 56. The cooling fluids are expelled from the airfoil 12 through the trailing edge 32 of the airfoil 12.

In at least one embodiment, the cooling system 14 of the airfoil 12 may be configured such that the cooling fluids received from the platform cooling system 10 are not further supplemented with cooling fluids in the airfoil 12 along the route to the exhaust holes in the trailing edge 32, as described in detail above. Rather, the airfoil cooling system 14 receives cooling fluids from the platform cooling system 10 and passes those cooling fluids through the airfoil 12 without receiving cooling fluid supplements. The cooling fluids may be injected into the leading edge cooling fluid supply channel 44 from either the platform cooling system 10 in the OD region 15 or the platform cooling system 10 in the ID region 17, or from both. Thus, cooling fluids may flow through an ID platform cooling system 10, through the airfoil cooling system 14, and be expelled out of the airfoil 12 without being supplemented by additional cooling fluids, or cooling fluids may flow through an OD platform cooling system 10, through the airfoil cooling system 14, and be expelled out of the airfoil 12 without being supplemented by additional cooling fluids, or cooling fluids may flow from OD and ID platform cooling systems 10, through the airfoil cooling system 14, and be expelled out of the airfoil 12 without being supplemented by additional cooling fluids. Such a cooling configuration is practical in composite airfoils 12 as composite airfoils 12 as capable of being operated at a higher temperature than conventional metal airfoils and, as a result, require less cooling fluids to prevent damage from thermal stress.

The foregoing is provided for purposes of illustrating, explaining, and describing embodiments of this invention. Modifications and adaptations to these embodiments will be apparent to those skilled in the art and may be made without departing from the scope or spirit of this invention.

We claim:

1. A turbine airfoil, comprising:

a generally elongated airfoil formed from an outer wall having a leading edge, a trailing edge, a pressure side, a suction side, a first platform at first end of the generally elongated airfoil, an inner core positioned internally in the generally elongated airfoil between the pressure and suction sides, a laminate layer joined to the inner core and forming the leading edge, trailing edge, pressure and suction sides, and a cooling system in the elongated airfoil formed from at least one internal cooling channel; and a cooling fluid preheating system in the first platform formed from at least one cooling channel in the first platform in communication with the cooling system in the elongated airfoil for preheating cooling fluids before the cooling fluids enter the cooling system in the elongated airfoil;

wherein the at least one cooling fluid preheating system in the platform and the cooling system in the airfoil form a continuous cooling system uninterrupted with additional cooling fluids along the cooling system from a first end of the cooling system to an exhaust of the cooling system in a trailing edae of the airfoil;

a shroud proximate to the first platform and comprising at least one cooling fluid supply hole, wherein the shroud forms a cooling supply manifold between the first platform that extends for a spanwise width of the generally elongated airfoil and wherein the cooling supply manifold is in fluid communication with a leading edge cooling fluid supply chamber in the cooling channel;

wherein the cooling channel is formed from the leading edge cooling fluid supply chamber positioned proximate to the leading edge of the generally elongated airfoil extending generally spanwise within the airfoil, a trailing edge supply channel extending generally spanwise within the airfoil proximate to the trailing edge, a plurality of pressure side channels extending generally chordwise within the inner core of the airfoil proximate to the pressure side and from the leading edge cooling fluid supply chamber to the trailing edge supply channel, a plurality of suction side channels extending generally chordwise within the inner core of the airfoil proximate to the suction side and from the leading edge cooling fluid supply chamber to the trailing edge supply channel, and a plurality of trailing edge cooling channels extending generally chordwise within the airfoil and in fluid communication with the trailing edge supply channel and between the trailing edge supply channel and the trailing edge.

2. The turbine airfoil of claim 1, wherein the first platform is an OD platform.

3. The turbine airfoil of claim 2, wherein the OD platform further comprises at least one airfoil supply hole extending between the at least one airfoil cooling fluid supply chamber and the cooling system in the elongated airfoil.

4. The turbine airfoil of claim 1, further comprising a second platform at a second end of the generally elongated airfoil opposite the first end and at least one cooling channel in the second platform in communication with the cooling system in the elongated airfoil for preheating cooling fluids before the cooling fluids enter the cooling system in the elongated airfoil.

5. The turbine airfoil of claim 4, wherein the second platform is an ID platform.

6. The turbine airfoil of claim 5, wherein the ID platform further comprises at least one airfoil supply hole extending between the at least one airfoil cooling fluid supply chamber and the cooling system in the elongated airfoil.

7. The turbine airfoil of claim 1, wherein the first platform is an ID platform.

8. The turbine airfoil of claim 1, wherein the generally elongated airfoil is formed from a composite material.

9. The turbine airfoil of claim 1, wherein the laminate layer is a ceramic matrix composite.

10. A composite turbine airfoil, comprising:

a generally elongated airfoil formed from a generally elongated airfoil formed from an outer wall having a leading edge, a trailing edge, a pressure side, a suction side, an inner core and a ceramic matrix composite laminate layer joined to the inner core, a first platform at a first end, a second platform at a second end opposite the first end, and a cooling system in the elongated airfoil formed from at least one internal cooling channel; and a cooling fluid preheating system in the first platform for preheating cooling fluids before the cooling fluids enter the cooling system in the elongated airfoil; and wherein the cooling system in first platform and in the elongated airfoil form a continuous cooling system uninterrupted with additional cooling fluids along the cooling system from a first end of the cooling system to an exhaust of the cooling system in the airfoil;

a shroud proximate to the first platform and comprising at least one cooling fluid supply hole, wherein the shroud forms a cooling supply manifold between the first platform that extends for a spanwise width of the generally elongated airfoil and wherein the cooling supply manifold is in fluid communication with a leading edge cooling fluid supply chamber in the cooling channel;

wherein the cooling channel is formed from the leading edge cooling fluid supply chamber positioned proximate to the leading edge of the generally elongated airfoil extending generally spanwise within the airfoil, a trailing edge supply channel extending generally spanwise within the airfoil proximate to the trailing edge, a plurality of pressure side channels extending generally chordwise within the inner core of the airfoil proximate to the pressure side and from the leading edge cooling fluid supply chamber to the tailing edge supply channel, a plurality of suction side channels extending generally chordwise within the inner core of the airfoil proximate to the suction side and from the leading edge cooling fluid supply chamber to the trailing edge supply channel, and a plurality of tailing edge cooling channels extending generally chordwise within the airfoil and in fluid communication with the trailing edge supply channel and between the trailing edge supply channel and the tailing edge.

11. The composite turbine airfoil of claim 10, further comprising a cooling fluid preheating system in the second platform for preheating cooling fluids before the cooling fluids enter the cooling system in the elongated airfoil, wherein the cooling fluid preheating system in first platform, the cooling fluid preheating system in the second platform, and the cooling system in the elongated airfoil form a continuous cooling system uninterrupted with additional cooling fluids along the cooling system from a first end of the cooling system in the first or second platforms to an exhaust of the cooling system in the airfoil.

12. A turbine airfoil, comprising:

a generally elongated airfoil formed from an outer wall having a leading edge, a trailing edge, a pressure side, a suction side, a first platform at a first end of the generally elongated airfoil, and a cooling system in the elongated airfoil formed from at least one internal cooling channel;

a cooling fluid preheating system in the first platform formed from at least one cooling channel in the first platform in communication with the cooling system in the elongated airfoil for preheating cooling fluids before the cooling fluids enter the cooling system in the elongated airfoil;

wherein the at least one cooling fluid preheating system in the platform and the cooling system in the airfoil form a continuous cooling system uninterrupted with additional cooling fluids along the cooling system from a first end of the cooling system to an exhaust of the cooling system in a trailing edge of the airfoil;

a shroud proximate to the first platform and comprising at least one cooling fluid supply hole, wherein the shroud forms a cooling supply manifold between the first platform that extends for a spanwise width of the generally elongated airfoil and wherein the cooling supply manifold is in fluid communication with a leading edge cooling fluid supply chamber in the cooling channel;

wherein the cooling channel is formed from the leading edge cooling fluid supply chamber positioned proximate to the leading edge of the generally elongated airfoil extending generally spanwise within the airfoil, a trailing edge supply channel extending generally spanwise within the airfoil proximate to the trailing edge, a plurality of pressure side channels extending generally chordwise within the inner core of the airfoil proximate to the pressure side and from the leading edge cooling fluid supply chamber to the trailing edge supply channel, a plurality of suction side channels extending generally chordwise within the inner core of the airfoil proximate to the suction side and from the leading edge cooling fluid supply chamber to the trailing edge supply channel, and a plurality of trailing edge cooling channels extending generally chordwise within the airfoil and in fluid communication with the trailing edge supply channel and between the trailing edge supply channel and the trailing edge; and wherein cooling fluids flowing through the cooling fluid preheating system are heated at least about 200 degrees before entering the cooling system in the generally elongated airfoil.

* * * * *